US010399724B2

(12) United States Patent
Aiello et al.

(10) Patent No.: US 10,399,724 B2
(45) Date of Patent: Sep. 3, 2019

(54) PACKAGING MACHINE AND METHOD FOR PRODUCING PACKAGES FROM A PACKAGING MATERIAL

(71) Applicant: Tetra Laval Holdings & Finance S.A., Pully (CH)

(72) Inventors: Vincenzo Aiello, Nonantola Modena (IT); Andrea Nicoli, Modena (IT); Giuseppe Vandelli, Scandiano Reggio Emilia (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/558,574

(22) PCT Filed: Mar. 24, 2016

(86) PCT No.: PCT/EP2016/056502
§ 371 (c)(1),
(2) Date: Sep. 15, 2017

(87) PCT Pub. No.: WO2016/165922
PCT Pub. Date: Oct. 20, 2016

(65) Prior Publication Data

US 2018/0057199 A1 Mar. 1, 2018

(30) Foreign Application Priority Data

Apr. 14, 2015 (EP) ..... 15163443

(51) Int. Cl.
*B65B 57/04* (2006.01)
*B65B 41/16* (2006.01)
(Continued)

(52) U.S. Cl.
CPC ..... *B65B 57/04* (2013.01); *B65B 9/20* (2013.01); *B65B 41/16* (2013.01); *B65B 41/18* (2013.01); *B65B 55/04* (2013.01)

(58) Field of Classification Search
CPC ..... B65B 55/04; B65B 55/06; B65B 55/08; B65B 55/10; B65B 55/103; B65B 9/20;
(Continued)

(56) References Cited

U.S. PATENT DOCUMENTS 3,592,372 A * 7/1971 James ..... B29C 53/52 226/22
3,680,446 A * 8/1972 James ..... B65B 9/20 226/22
(Continued)

FOREIGN PATENT DOCUMENTS

EP 2357138 8/2011
GB 1373203 11/1974

OTHER PUBLICATIONS

International Search Report and Written Opinion from corresponding PCT Application No. PCT/EP2016/056502 dated May 11, 2016 (10 pages).

*Primary Examiner* — Alexander M Valvis
*Assistant Examiner* — Eduardo R Ferrero
(74) *Attorney, Agent, or Firm* — Finnegan, Henderson, Farabow, Garrett & Dunner, L.L.P.

(57) ABSTRACT

A packaging machine may be provided for producing packages from a packaging material advanced along an advancing path. The packaging material may have a longitudinal edge arranged along the advancing path and a mark configured to provide an indication about the position of the packaging material. The packaging machine may include a forming unit configured to fold the packaging material into a tube having a longitudinal axis arranged along the advancing path, a first sensor configured to detect the position of the
(Continued)

edge and generate a first control signal, a second sensor configured to read the mark and to generate a second signal, and a control device having an actuation device configured to move the packaging material in a direction arranged transversally with respect to the advancing path based on the first control signal and second signal. A method for producing packages from a packaging material may additionally be provided.

15 Claims, 5 Drawing Sheets

(51) Int. Cl.
*B65B 41/18* (2006.01)
*B65B 9/20* (2012.01)
*B65B 55/04* (2006.01)

(58) Field of Classification Search
CPC ..... B65B 9/2028; B65B 41/18; B65B 41/16; B65B 57/04; B65H 23/032; B65H 23/038; B65H 23/048
USPC ..... 53/426, 167, 451, 551
See application file for complete search history.

(56) References Cited

U.S. PATENT DOCUMENTS 3,731,864 A * 5/1973 Ott, Jr. ..... B65H 23/0212 226/19
4,384,438 A * 5/1983 Hilmersson ..... B65B 41/18 53/51
4,477,006 A * 10/1984 Sharp ..... B65H 23/038 226/18
4,556,208 A * 12/1985 Campbell ..... B65H 39/16 226/21
4,860,522 A * 8/1989 Cherney ..... B65B 41/18 53/451
5,174,096 A * 12/1992 Fukuda ..... B65B 9/20 226/19
5,226,577 A * 7/1993 Kohler ..... B65H 23/038 226/18
5,377,474 A * 1/1995 Kovacs ..... B65B 9/2028 53/451
5,505,037 A * 4/1996 Terminella ..... B65B 9/20 53/133.4
5,756,979 A * 5/1998 Murakami ..... B26D 5/34 235/454
6,067,778 A * 5/2000 Yamamoto ..... B65B 9/20 226/30
6,397,557 B1 * 6/2002 Bassissi ..... B29C 53/54 53/51
6,460,748 B1 10/2002 Boschi
6,668,526 B2 * 12/2003 Schmidt ..... B65H 23/038 226/21
6,751,925 B1 * 6/2004 Kinoshita ..... B65B 9/20 356/240.1
7,007,440 B2 * 3/2006 Kinoshita ..... B29C 53/48 53/51
7,399,983 B2 * 7/2008 Yokote ..... B29C 66/4312 250/559.39
7,521,075 B2 * 4/2009 Scarabelli ..... B65B 41/18 235/454
7,559,184 B2 * 7/2009 Grzonka ..... B65B 9/2021 53/451
9,027,732 B2 * 5/2015 Santi ..... B65G 47/846 198/408
2002/0088202 A1 * 7/2002 Van Rens ..... B29C 65/18 53/133.4
2002/0104290 A1 * 8/2002 Kurth ..... B23K 26/0846 53/426
2003/0093971 A1 * 5/2003 Terminella ..... B65B 9/20 53/133.4
2004/0168407 A1 * 9/2004 Borghi ..... B65B 41/18 53/451
2004/0259709 A1 * 12/2004 Guidotti ..... B65D 5/4266 493/356
2009/0266034 A1 * 10/2009 Rosberg ..... B65B 9/20 53/452
2009/0293428 A1 * 12/2009 Konno ..... B65B 9/2021 53/415
2010/0016137 A1 * 1/2010 Benedetti ..... B65B 41/16 493/162
2011/0203221 A1 * 8/2011 Dorati ..... B29C 65/5042 53/64
2012/0210681 A1 * 8/2012 Hennissen ..... B65B 9/213 53/559
2012/0272619 A1 * 11/2012 Tavernari ..... B65B 41/18 53/412
2014/0102617 A1 4/2014 Hutter
2014/0274629 A1 * 9/2014 Lykowski ..... B65B 41/16 493/17

* cited by examiner

PACKAGING MACHINE AND METHOD FOR PRODUCING PACKAGES FROM A PACKAGING MATERIAL

CROSS-REFERENCE TO RELATED PATENT APPLICATIONS

This is a National Phase of International Application No. PCT/EP2016/056502, filed Mar. 24, 2016, which claims the benefit of European Application No. 15163443.3, filed Apr. 14, 2015. The entire contents of the above-referenced applications are expressly incorporated herein by reference.

TECHNICAL FIELD

The present invention relates to a packaging machine for producing packages from a packaging material. In particular, the invention relates to a packaging machine comprising a control device for controlling the position of a tube formed by folding the packaging material and filled with a product to be packaged.

The present invention also relates to a method for producing packages from a packaging material.

BACKGROUND OF INVENTION

Packaging machines for packaging pourable food products, such as fruit juice, wine, tomato sauce, pasteurized or long-storage (UHT) milk, etc., are known, in which the packages are formed from a continuous tube of packaging material defined by a longitudinally sealed web of packaging material.

The packaging material has a multilayer structure comprising a layer of paper material covered on both sides with layers of heat-seal plastic material, e.g. polyethylene, and, in the case of aseptic packages for long-storage products, such as UHT milk, also comprises a layer of barrier material defined, for example, by an aluminium film, which is superimposed on a layer of heat-seal plastic material and is in turn covered with another layer of heat-seal plastic material eventually defining the inner face of the package contacting the food product.

The packaging material has a plurality of crease lines along which the packaging material is folded to obtain the packages. The final shape of the packages depends on the crease line pattern in the packaging material.

To produce such packages, the web of packaging material is unwound off a reel and fed through a sterilizing unit, in which it is sterilized, for example by immersion in a liquid sterilizing agent, normally a concentrated hydrogen peroxide and water solution.

Once the web has been sterilized, the sterilizing agent is removed, e.g. vaporized by heating, from the surfaces of the packaging material, and the web of packaging material so sterilized is maintained in a closed sterile environment, and is folded and sealed longitudinally to form the tube.

More specifically, the web of packaging material is fed vertically through a number of successive forming assemblies, which interact with the web to fold it gradually into a cylinder. More specifically, the forming assemblies comprise respective folding members defining a number of compulsory passages varying gradually in section from an open C to a substantially circular shape.

By interacting with the folding members, opposite lateral portions of the web are superimposed one on top of the other, so as to form the tube.

At a sealing station, downstream of the folding assemblies, the superimposed lateral portions of the web are heat sealed to each other to form a longitudinal seal of the tube.

The tube is filled continuously with the pourable food product and then sent to a forming and transverse sealing unit for forming the individual packages and in which the tube is gripped between pairs of jaws to seal the tube transversely and form pillow packs.

The pillow packs are separated by cutting the sealed portions between the pillow packs, and are then fed to a final folding station where they are folded mechanically into the final shape.

To ensure good transverse sealing of the tube of packaging material and correct folding of the pillow packs along the crease lines, the tube must be fed in a predetermined or desired angular position with respect to its own axis and to the structure of the packaging machine. When the tube of packaging material is sealed transversely, in particular by means of an ultrasonic sealing device, the superimposed lateral portions of the web must engage a respective groove formed in a counter element opposing an active element of the sealing device between which the packaging material is gripped under pressure. If not, this may result in an incorrect distribution of the contact pressures between the active element and the counter element of the sealing device and the packaging material, thus negatively affecting the quality of the seal.

In addition, if the tube of packaging material is twisted around its own axis with respect to the predetermined or desired angular position, it may happen that the crease lines are not aligned with the pairs of jaws of the forming and transverse sealing unit so impairing the forming of the packages. In particular, if the pairs of jaws fold the packaging material at regions thereof different from the creasing lines, the packages may have slightly curved longitudinal edges and, therefore, a bad visual appearance.

In known packaging machines, the angular position of the tube may vary, in actual use, from the predetermined or desired angular position, due to the lateral edges of the web not being perfectly straight, and due to the impact of the pairs of jaws on the tube.

To minimize the angular shift of the tube with respect to the predetermined or desired angular position, the folding member of one of the forming assemblies is connected to the structure of the packaging machine in angularly adjustable manner about the axis of the tube being formed, so as to enable adjustment of the angular position of the tube. This is done manually, however, by the operator at the start of the cycle and, if necessary, following routine checks of the packages coming off the machine.

The correction made by the operator therefore takes a relatively long time, normally in the region of a few minutes, which, given the high output rate of the packaging machines considered, amounts to a relatively large number of packages being rejected at the end of the cycle.

DISCLOSURE OF INVENTION

An object of the invention is to improve the positioning of packaging material in a packaging machine.

Another object of the invention is to improve the positioning of a tube of packaging material in a packaging machine.

A further object of the invention is to prevent twisting of a tube of packaging material around its own longitudinal axis in a packaging machine.

In a first aspect of the invention, there is provided a packaging machine for producing packages from a packaging material according to claim 1.

In a second aspect of the invention, there is provided a method for producing packages from a packaging material according to claim 10.

BRIEF DESCRIPTION OF THE DRAWINGS

A preferred, non-limiting embodiment of the invention will be described by way of example with reference to the accompanying drawings, in which.

DETAILED DESCRIPTION OF PREFERRED EMBODIMENTS

With reference to FIGS. 1 to 7, there is disclosed a packaging machine 1 for continuously producing sealed packages 2, containing a pourable food product, such as pasteurized or UHT milk, fruit juice, wine, etc., from packaging material 3 unwound off a reel (not shown) and fed along an advancing path P. When unwound off the real the packaging material has the shape of a planar web 100.

Figure 2:
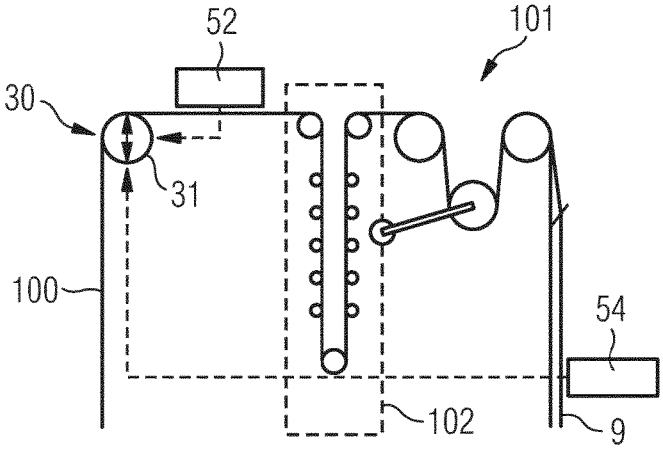
FIG. 2 is a schematic side view of the packaging machine of FIG. 1.

By means of known guide elements, rollers or similar devices (not shown), the web 100 is fed along the advancing path P through a sterilizing unit 101 comprising a sterilizing bath 102 (schematically shown in FIG. 2).

In another embodiment (not shown), the sterilizing unit may comprise other sterilizing devices, for example a sterilizing device that irradiates the packaging material 3 with a low voltage electron beam.

The web 100 is fed along the advancing path P through a chamber 4 (shown by the dash line in FIG. 1), which is formed in a fixed structure 5 (shown only partly in FIG. 1) of the packaging machine 1, and in which the web 100 is maintained in a sterile-air environment.

The chamber 4 comprises a top portion 6, which communicates with the sterilizing unit 101, and in which the web 3 is guided along a vertical portion P1 and a bottom portion 8 extending vertically from the top portion 6 along the portion P1.

Inside the bottom portion 8, the web 3 is folded longitudinally into a cylinder to form a continuous vertical tube 9 having a longitudinal axis A coaxial with the portion P1, and is gradually formed into a number of sealed packs 10, which are subjected to successive mechanical folding operations (not forming part of the present invention and therefore not shown) to form the finished packages 2. In particular, the packaging machine 1 comprises a forming and transverse sealing unit provided with pairs of jaws that interact with the tube 9 to fold and seal the tube 9 to obtain the packs 10.

The packaging machine 1 comprises a number of forming assemblies, in the embodiment shown four forming assemblies, i.e. a first forming assembly 11, a second forming assembly 12, a third forming assembly 13 and a fourth forming assembly 14 carried by the structure 5, located along the portion P1 inside chamber 4, and interacting with the web 100 to fold the web 100 gradually into a cylinder and mutually superimpose a first lateral portion 100*a* of the web 100 and a second lateral portion 100*b* of the web 100, opposite the first lateral portion 100*a*, to form the tube 9.

In the embodiment shown, the first forming assembly 11 is housed inside the top portion 6 along the portion P1, and the second forming assembly 12, the third forming assembly 13 and the fourth forming assembly 14 are located one after the other along the portion P1 inside the bottom portion 8.

The packaging machine 1 also comprises a sealing device 15 (shown schematically in FIG. 1) located along the portion P1, downstream of the fourth forming assembly 14, and which provides for sealing the superimposed first lateral portion 100*a* and second lateral portion 100*b*, so as to form a fluidtight longitudinal seal in the tube 9.

The tube 9 is filled continuously with the sterilized or sterile-processed food product by means of a pour conduit 20 extending partly inside the tube 9 and forming part of a filling circuit (not shown).

At the above-mentioned forming and transversal sealing unit (not shown) the tube 9 is then sealed and cut along equally spaced transverse sections to form the packs 10 from which the packages 2 are produced.

Figure 1:
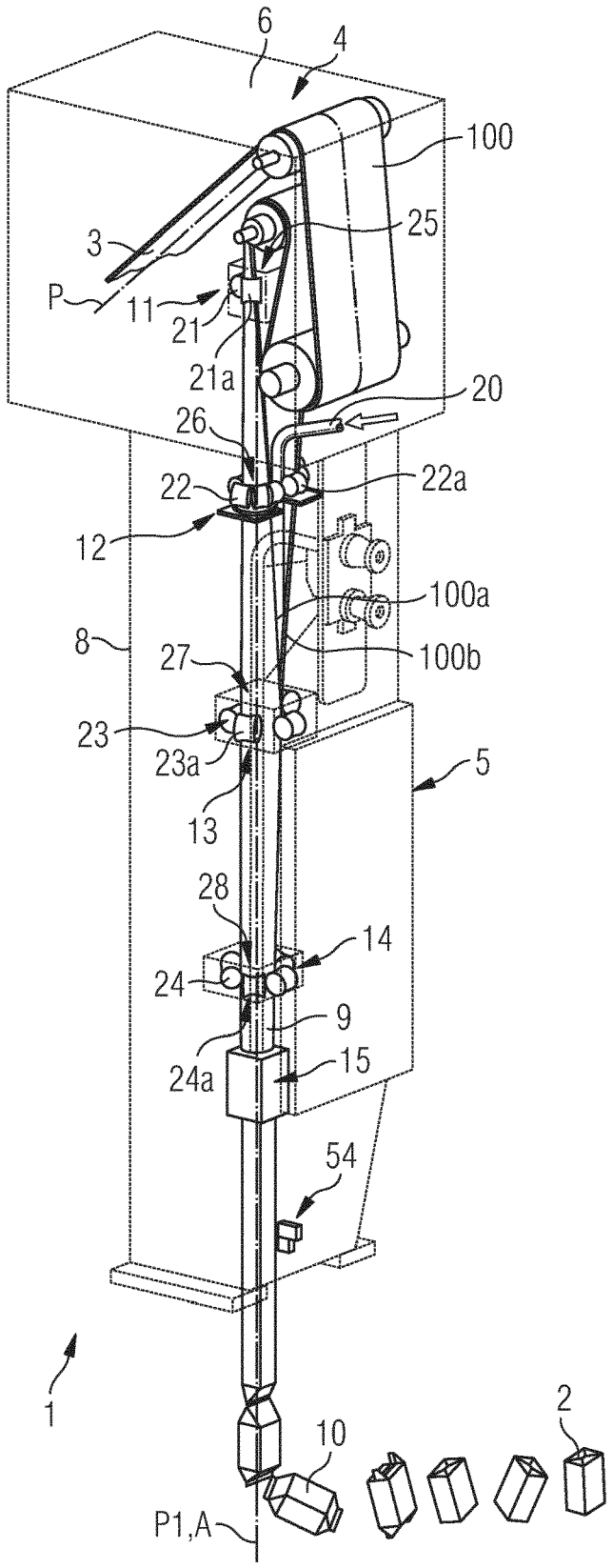
FIG. 1 is a perspective view, with parts removed for clarity, of a packaging machine for producing packages form a packaging material, in accordance with the invention.

With particular reference to FIG. 1, the first forming assembly 11 comprises a plurality of first folding rollers 21 having axes perpendicular to the portion P1. The lateral surfaces 21*a* of the first folding rollers 21 define a first compulsory passage 25 for the web 100 being folded.

Similarly, the second forming assembly 12 comprises a plurality of second folding rollers 22 having axes perpendicular to the portion P1. The lateral surfaces 22*a* of the second folding rollers 22 define a second compulsory passage 26 for the web 100 being folded.

In the same way, the third forming assembly 13 comprises a plurality of third folding rollers 23 having axes perpendicular to the portion P1. The lateral surfaces 23*a* of the third folding rollers 23 define a third compulsory passage 27 for the web 100 being folded.

Similarly, the fourth forming assembly 14 comprises a plurality of fourth folding rollers 24 having axes perpendicular to the portion P1. The lateral surfaces 24*a* of the fourth folding rollers 24 define a fourth compulsory passage 28 for the web 100 being folded.

More specifically, the first compulsory passage 25, the second compulsory passage 26, the third compulsory passage 27 and the fourth compulsory passage 28 vary gradually in section, along the portion P1, from an open C shape, defined by the first folding rollers 21 to a substantially circular shape defined by the fourth folding rollers 24.

With reference to FIGS. 2 to 7, the packaging machine 1 comprises a control device 30 for controlling the angular position of the tube 9 being formed with respect to the axis A, i.e. the rotation, or twisting, of the tube 9 around the axis A.

The control device 30 moves the web 100 in a direction T arranged transversally with respect to the advancing path P.

The control device 30 comprises a driving roller 31 that supports the web 3. In other words, the web 30 is in contact with, and partially wound around, the driving roller 31.

The driving roller 31 is positioned upstream of the sterilizing unit 101.

The driving roller 31 is rotatable around a rotation axis B and is supported by a movable bracket 32 so that the rotation axis B may rotate in a plane W defined by the web 100.

Figure 6:
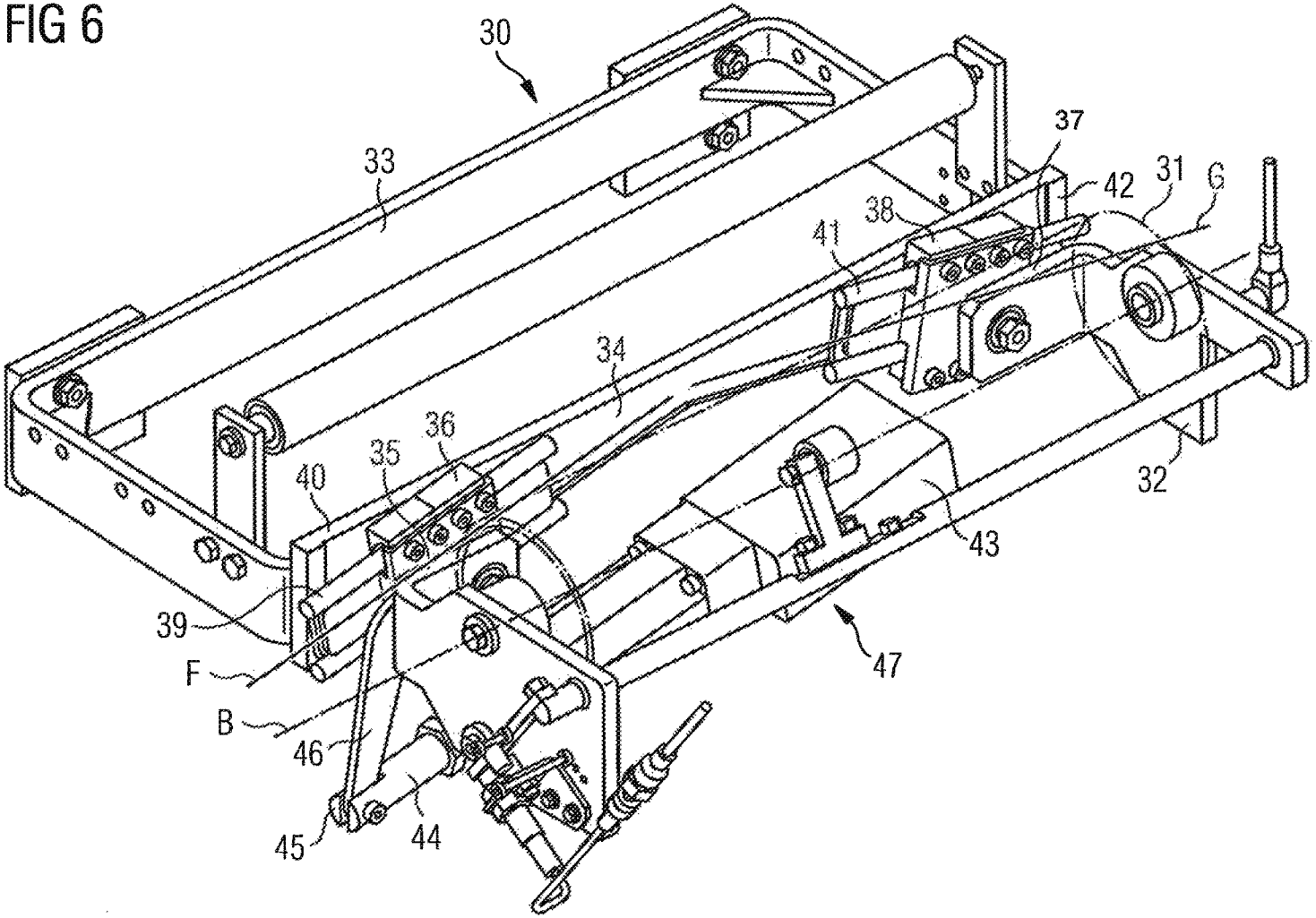
FIG. 6 is a perspective view of a driving unit of the packaging machine of FIG. 1.
Figure 7:
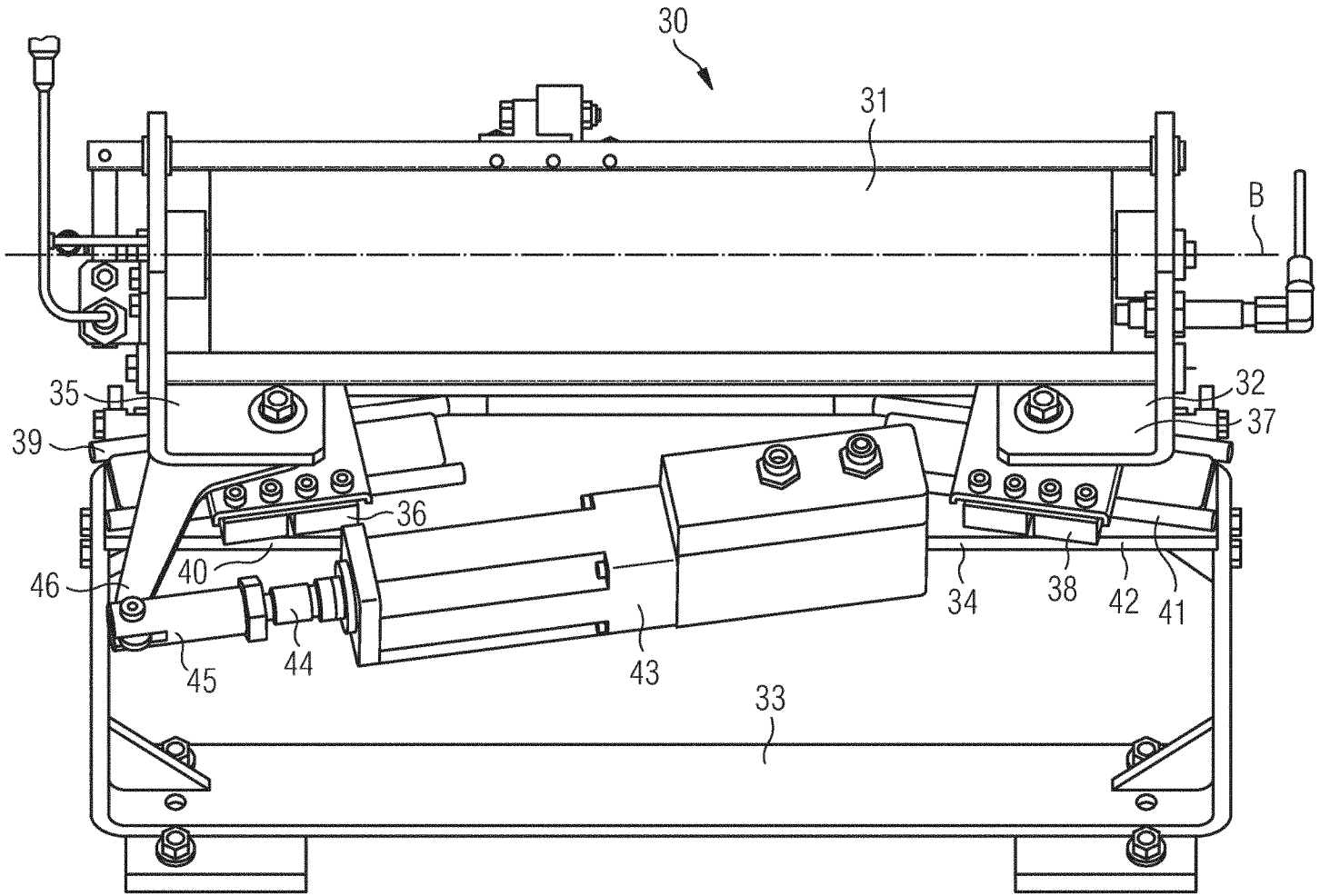
FIG. 7 is another perspective view of the driving unit of FIG. 6.

With reference to FIGS. 6 and 7, the control device 30 comprises a fixed frame 33 provided with a plate 34 that supports the bracket 32.

The bracket 32 has a first side portion 35 hinged to a first slide 36 and a second side portion 37, opposite the first side portion 35, hinged to a second slide 38.

The control device 30 further comprises a first guide element 39 connected to a first portion 40 of the plate 34 and a second guide element 41, connected to a second portion 42 of the plate 34, opposite the first portion 40.

The first slide 36 is slideable along the first guide element 39.

The second slide 38 is slideable along the second guide element 41.

The first guide element 39 is arranged along a first sliding direction F that is inclined with respect to the rotation axis B.

The second guide element 41 is arranged along a second sliding direction G that is inclined with respect to the rotation axis B.

The first sliding direction F and the second guiding direction G converge towards each other.

The control device 30 further comprises an actuating device 47 for moving the first slide 36 along the first guide element 39 and the second slide 38 along the second guide element 41.

In the embodiment shown, the actuating device 47 has a driving element 43 connected to the frame 33 and a stem 44 slideable within the driving element 43 and provided with an end 45 that is coupled to a lever 46.

The lever 46 is connected to the first slide 36. In this way, when the stem 44 is extended from the driving element 43, the first slide 36 and the second slide 38 move from right to left in FIG. 6 and the driving roller 31 (the rotation axis B) rotates anti-clockwise in plane W. When the stem 44 is retracted into the driving element 43 the first slide 36 and the second slide 38 move from left to right in FIG. 6 and the driving roller 31 (the rotation axis B) rotates clockwise in plane W.

The packaging material 3 comprises a plurality of patterns of crease lines (not shown) along which the packaging material 3 is folded to produce the packages 2.

The patterns of crease lines are identical to each other and are arranged one after the other along the longitudinal dimension of the packaging material 3.

In this way, the packaging material comprises a plurality of packaging material units 50 (schematically shown in FIGS. 3 to 5), each packaging material unit 50 being intended to form a package 2.

The packaging material 3 also comprises a plurality of reference marks 51 which provide an indication of the position of the packaging material 3, in particular of the position of the packaging material units 50.

Each packaging material unit 50 has a corresponding mark 51 which is arranged in a fixed position with respect to the pattern of crease lines of the packaging material unit 50. In this way, the position of the mark 51 provides precise information about the position of the pattern of crease lines.

The marks 50 may be magnetic marks carrying a magnetic field providing position information.

The marks 50 may be obtained through a magnetisable ink that is distributed onto the packaging material 3 when a decor is printed on the packaging material 3. The ink is subsequently magnetized when the packaging material 3 is creased, so that the position of each crease pattern matches the position of the corresponding mark 50.

The control device 30 further comprises a first sensor 52 arranged for detecting the position of an edge 53 of the web 100. In the embodiment shown, the first sensor 52 detects the position of the second lateral edge 100*b*.

The first sensor 52 generates a first control signal S1 indicating the displacement of the edge 53 along the transversal direction T with respect to a reference edge position X.

The control device 30 further comprises a second sensor 54 arranged for detecting the position of the marks 50 and generating a second signal S2 indicating the rotation of the tube 9 around the axis A with respect to a reference tube position Y.

In particular, the second sensor 54 may be a magnetic sensor.

Figure 3:
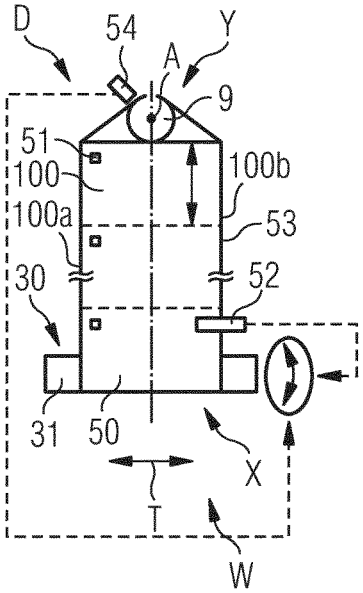

FIG. 3 shows a desired working configuration D in which, the edge 53 is in the reference edge position X, i.e. there is no displacement along the transversal direction T, and the tube is in the reference tube position Y, i.e. there is no rotation around the axis A.

During operation, the packaging material 3 may move away from the desired working configuration D.

In this case, the control device 30 acts on the packaging material 3 to move the packaging material 3 towards the desired working configuration D.

Figure 4:
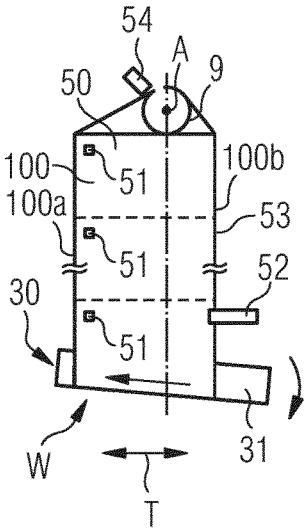
FIGS. 3 to 5 are schematic top views of the packaging machine of FIG. 1, in different working configurations.

In particular, as shown in FIG. 4, if the driving roller 31—through the actuating device 47—is rotated clockwise in plane W, the web 100 shift towards the left along the transversal direction T and the tube 9 rotates counter-clockwise around the axis A.

Figure 5:
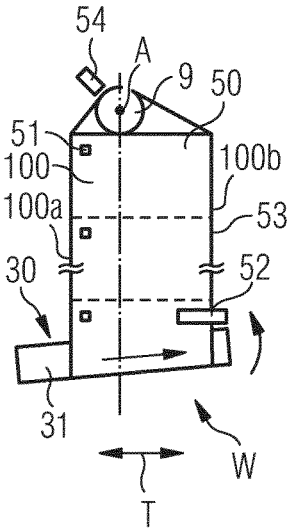

On the contrary, as shown in FIG. 5, if the driving roller 31—through the actuating device 47—is rotated counter-clockwise in plane W, the web 100 shift towards the right along the transversal direction T and the tube 9 rotates clockwise around the axis A.

Figure 8:
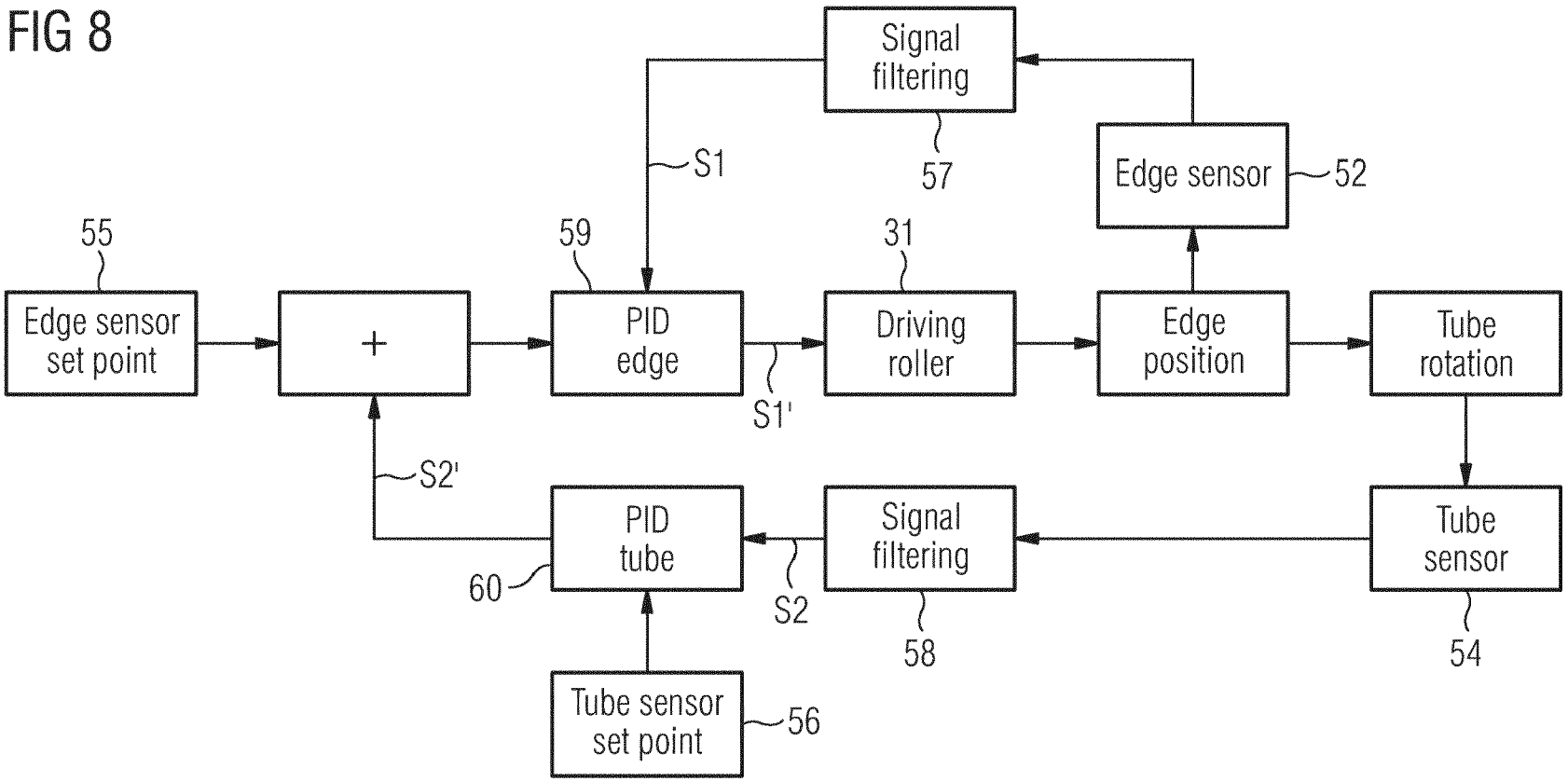
FIG. 8 is a block diagram showing the control loop architecture of the packaging machine of FIG. 1.

With reference to FIG. 8, there is disclosed the control loop architecture of the packaging machine of FIG. 1.

The control device 30 comprises a logic control unit which receives, as input data, an edge set point 55, i.e. a first set point of the first sensor 54 corresponding, for example, to the reference edge position X, and a tube set point 56, i.e. a second set point of the second sensor 54 corresponding, for example, to the reference tube position Y.

The first sensor 52 generates the first control signal S1 indicating the position of the edge 53 along the transversal direction T.

The first control signal S1 is filtered by a first filter 57.

The first control signal S1 is sent to a first PID (proportional-integral-derivative) control 59 that generates a further first control signal S1' that controls the driving roller 31, i.e.—through the actuating device 47—controls the tilting of the rotation axis B in plane W.

The second sensor 54 generates the second signal S2 indicating the rotation of the tube 9 around the axis A.

The second signal S2 is filtered by a second filter 58.

The second signal S2 is sent to a second PID (proportional-integral-derivative) control 60 that generates a further second signal S2' that is sent to the first PID (proportional-integral-derivative) control 59.

The first PID (proportional-integral-derivative) control 59 receives, as input information, the first control signal S1 and the edge set point 55, compares the first control signal S1 and the edge set point 55 and, taking into account the further second signal S2', which is also an input information for the first PID (proportional-integral-derivative) control 59, generates the further first control signal S1'.

The second PID (proportional-integral-derivative) control 60 receives, as input information, the second signal S2 and the tube set point 56, compares the second signal S2 and the tube set point 56 and generates the further second signal S2'.

As explained above, the first PID (proportional-integral-derivative) control 59 generates the further first control signal S1' not only on the basis of the edge set point 55 and the first control signal S1, but also on the basis of the further second signal S2', which takes into account the tube rotation.

This means that the driving roller 31 moves the web 100 along the transversal direction T to such an extent as to compensate not only for the displacement of the edge 53 with respect to the reference edge position X, but also for the rotation of the tube 9 with respect to the reference tube position Y.

Owing to the invention, it is possible to correct the position of the tube 9 during operation of the packaging machine in order to minimize tube twisting.

The driving roller 31 and the actuating device 47, being positioned upstream of the sterilizing unit 101, do not constitute a source of contamination for the packaging material 3.

Clearly, changes may be made to the packaging machine 1 as described and illustrated herein without, however, departing from the scope of the accompanying claims.

The invention claimed is:

1. A packaging machine for producing packages from a planar web of packaging material advanced along an advancing path, the packaging material having a longitudinal edge arranged along the advancing path and a mark configured to provide an indication about the position of the packaging material, the packaging machine comprising:

a driving roller configured to support the planar web of packaging material along a section of the advancing path, wherein the driving roller is configured to move the planar web of packaging material in a transversal direction transverse to the advancing path;

a first sensor configured to detect the position of the longitudinal edge of the planar web of packaging material along the transversal direction and to generate a first control signal based on the detected position of the longitudinal edge;

a forming unit configured to fold the planar web of packaging material into a tube, the tube having a longitudinal axis arranged along the advancing path;

a second sensor configured to detect the mark of the packaging material within a portion of the tube and to generate a second control signal based on the detection of the mark, wherein the second control signal indicates the rotational position of the tube around the longitudinal axis; and a control device configured to:

receive the first control signal and the second control signal, generate an actuation control signal based on the first control signal and the second control signal, and arrange the tube in a desired rotational position about the longitudinal axis by adjusting the position of the driving roller based on the actuation control signal.

2. The packaging machine according to claim 1, wherein the mark of the packaging material is a magnetic mark carrying a magnetic field providing position information and the first sensor is a magnetic sensor.

3. The packaging machine according to claim 1, wherein the control device is configured to:

receive a first set point of the first sensor corresponding to an edge reference position of the longitudinal edge of the planar web of packaging material along the transversal direction;

compare the first control signal and the first set point to determine a displacement of the longitudinal edge along the transversal direction; and generate the actuation control signal based, at least in part, on the determined displacement of the longitudinal edge.

4. The packaging machine according to claim 1, wherein the control device is configured to:

receive a second set point of the second sensor corresponding to a reference position of the tube around the longitudinal axis;

compare the second control signal and the second set point to determine a rotational displacement angle of the tube; and generate the actuation control signal based, at least in part, on the determined rotational displacement angle of the tube.

5. The packaging machine according to claim 1, further comprising:

a sterilizing unit configured to sterilize the packaging material, the driving roller being arranged upstream of the sterilizing unit.

6. The packaging machine according to claim 1, further comprising:

a bracket rotatably supporting the driving roller and having a first side portion hinged to a first slide and a second side portion, opposite the first side portion, hinged to a second slide;

a first guide element connected to a first portion of a fixed frame; and a second guide element connected to a second portion of the fixed frame, opposite the first portion, wherein the first slide is slidably coupled to the first guide element and the second slide is slidably coupled to the second guide element, the first guide element being arranged along a first sliding direction that is inclined with respect to a rotation axis of the driving roller and the second guide element being arranged along a second sliding direction that is inclined with respect to the rotation axis of the driving roller, and wherein the control device is configured to adjust the position of the driving roller by controlling movement of the first slide along the first guide element and controlling movement of the second slide along the second guide element.

7. The packaging machine according to claim 1, wherein the driving roller is configured to move the planar web of packaging material in the transversal direction based on the first control signal and the second control signal.

8. The packaging machine according to claim 1, wherein the first sensor is situated upstream of the forming unit with respect to the advancing path;

wherein the second sensor is situated downstream from the forming unit with respect to the advancing path; and wherein the driving roller is situated upstream of the forming unit with respect to the advancing path.

9. The packaging machine according to claim 1, wherein the control device is configured to arrange the tube in the desired rotational position about the longitudinal axis by controlling rotation of the driving roller within a plane parallel to the advancing path.

10. A method for producing packages from a planar web of packaging material advanced along an advancing path, the packaging material having a longitudinal edge arranged along the advancing path and a mark configured to provide an indication about the position of the packaging material, the method comprising:

folding the planar web of packaging material into a tube, the tube having a longitudinal axis arranged along the advancing path;

sealing, via a sealing device, a first lateral portion of the packaging material and a second lateral portion of the packaging material, opposite the first lateral portion, when the first lateral portion and the second lateral portion are superimposed, so as to form a fluidtight longitudinal seal in the tube;

detecting, with a first sensor, the position of the longitudinal edge of the planar web of packaging material along a transversal direction, the transversal direction being transverse to the advancing path, and generating a first control signal indicative of the detected position of the longitudinal edge;

detecting, with a second sensor, the mark of the packaging material within a portion of the tube and generating a second control signal, based on the detection of the mark, indicative of the rotation of the tube around the longitudinal axis;

moving, via a control device having an actuating device, the packaging material in the transversal direction based on the first control signal and the second control signal, wherein the actuating device includes a driving roller configured to support the planar web of packaging material along a section of the advancing path;

generating a tube rotational displacement signal based on the second control signal;

generating, based on the first control signal and the tube rotational displacement signal, an actuation control signal; and arranging the tube in a desired rotational position about the longitudinal axis by adjusting the position of the driving roller with the actuating device based on the actuation control signal.

11. The method according to claim 10, wherein the mark of the packaging material is a magnetic mark carrying a magnetic field providing position information and the first sensor is a magnetic sensor.

12. The method according to claim 10, wherein generating the actuation control signal comprises:

receiving a first set point of the first sensor corresponding to an edge reference position of the longitudinal edge of the planar web of packaging material along the transversal direction;

comparing the first control signal and the first set point to determine a displacement of the longitudinal edge along the transversal direction; and generating the actuation control signal based on the determined displacement of the longitudinal edge.

13. The method according to claim 10, wherein generating the tube rotational displacement signal comprises:

receiving a second set point of the second sensor corresponding to a reference position of the tube around the longitudinal axis; and comparing the second control signal and the second set point to determine the tube rotational displacement signal.

14. The method according to claim 10, wherein the first sensor and the driving roller are situated upstream of the section of the advancing path in which the planar web of packing material is folded into the tube.

15. The method according to claim 10, wherein the actuating device is configured to arrange the tube in the desired rotational position about the longitudinal axis by rotating the driving roller within a plane parallel to the advancing path.

* * * * *